United States Patent [19]

Byszewski et al.

[11] Patent Number: 4,888,528

[45] Date of Patent: Dec. 19, 1989

[54] METHOD OF AND APPARATUS FOR ULTRAHIGH FREQUENCY STARTING OF HIGH INTENSITY DISCHARGE LAMPS

[75] Inventors: Wojciech W. Byszewski, Concord; Scott J. Butler, Rochdale; Robert J. Regan, Needham; Joseph M. Proud, Wellesley Hills, all of Mass.

[73] Assignee: GTE Laboratories Incorporated, Waltham, Mass.

[21] Appl. No.: 243,118

[22] Filed: Sep. 6, 1988

Related U.S. Application Data

[63] Continuation of Ser. No. 67,033, Jun. 29, 1987, abandoned.

[51] Int. Cl.[4] ..... H05B 41/00

[52] U.S. Cl. ..... 315/344; 315/124; 313/594; 313/607

[58] Field of Search ..... 315/124, 178, 92, 248, 315/344; 313/594, 607

[56] References Cited

U.S. PATENT DOCUMENTS

| | | | |
|---|---|---|---|
| 1,984,428 | 12/1934 | Pirani | 313/594 |
| 4,095,142 | 6/1978 | Murayama et al. | 315/246 |
| 4,287,454 | 9/1981 | Feuersanger et al. | 315/178 |
| 4,464,607 | 8/1984 | Peil et al. | 315/92 |

*Primary Examiner*—Robert L. Griffin
*Assistant Examiner*—T. Salindong
*Attorney, Agent, or Firm*—Frances P. Craig

[57] ABSTRACT

Ignition of high intensity discharge (HID) lamps can be enhanced by the application of ultrahigh frequency (UHF) electric fields at modest power levels. The implementation of UHF power assisted starting offers considerable advantage over known prior art lower frequency power starting methods. Solid state circuits and coupled means can be utilized as described therein.

21 Claims, 6 Drawing Sheets

METHOD OF AND APPARATUS FOR ULTRAHIGH FREQUENCY STARTING OF HIGH INTENSITY DISCHARGE LAMPS

This is a continuation of co-pending application Ser. No. 067,033, filed on June 29, 1987, now abandoned.

BACKGROUND OF THE INVENTION

1. Field of the Invention

This invention relates to methods of and apparatus for ultrahigh frequency starting of high intensity discharge (HID) lamps. Accordingly, it is a general object of this invention to provide new and improved methods and apparatus of such character.

2. General Background

Several different circuits, commonly used to ballast and to start HID lamps, have been described by J. F. Waymouth, "Electric Discharge Lamps", The MIT Press, Cambridge and London, 1971.

The circuits described therein usually have two functions during the starting phase: they promote a breakdown condition to initiate lamp starting and then they supply adequate energy to enable the transition from a glow phase to a final arc stage. In order to start most HID lamps, however, these functions should be separated, and therefore, a starting aid was usually added to a lamp ballast. In some types of HID lamps it was necessary to enhance starting by external ionization or by pulse injection through a third electrode. HID lamps may be started, or started and operated, by high frequency pulses. Y. Koshima et al., "Stable High Frequency Operation of HID Lamps and Their Ballast Design", presented at the 1983 CIE conference (Amsterdam), for example, report stable operation of HID lamps at radio frequencies (RF), although unstable phenomena are often encountered which may trigger undesirable acoustic resonances. These resonances have been overcome by frequency modulation, as reported by R. P. Bonazoli and F. W. Paget, "Anti-Acoustic Resonance Drive for HID Electronic Ballast", Report No. 761018 (Oct. 14, 1976), Lighting Products Group, Salem, Mass., GTE Sylvania, or by superposition of higher harmonics, as reported by Koshima et al., supra.

J. Lester and S. Cohen, "The RF Starting and its Application to Miniature Metal Halide Lamps", presented at the 1985 IES conference (Detroit), reported the utilization of 40 kHz RF power, a low frequency (LF), with 3–4 kV amplitude to initiate a discharge in 100 W Metalarc lamps. Its RF starter supplied enough energy to facilitate the glow to arc transition. The lamp operation was then maintained by a conventional ballast at 60 Hertz. The RF starter continued to operate, however, after lamp starting, thus causing power line noise during the on-state period of the lamp. In order to reduce this effect, a transistor, placed in series with the starter, lowered the output voltage after 5 to 15 minutes of operation. Alternatively, a broadband differential filter between the RF starter and the power line was used to reduce line noise.

Neither of the foregoing prior art circuits completely eliminated the line noise problem, and thus the need was created for a new starter for 100 W Metalarc lamp. A modified HPS (high pressure sodium) starter, marketed under the "Advance" brand name, is presently used to ignite these lamps. Starting aids based on the bimetal pulser have also been suggested by J. Lester, "Le Theorie de Bimetal", Report No. 830411 (Apr. 4, 1983), Lighting Products Group, Salem, Mass., GTE Sylvania. Very successful results in starting and hot restarting of many types of HID lamps have been achieved with spiral line, high voltage generators, as indicated by J. M. Proud, L. A. Riseberg, and C. N. Fallier, Jr., "Method and Apparatus for Starting High Intensity Discharge Lamps", U.S. Pat. No. 4,325,004, issued Apr. 13, 1982, and by C. N. Fallier, Jr. and J. M. Proud, "Pulse Injection Starting for High Intensity Discharge Metal Halide Lamps", U.S. Pat. No. 4,353,012, issued Oct. 5, 1982.

As discussed therein, the high frequency, high voltage pulses are produced every half cycle of the line voltage and are discontinued as soon as the lamp voltage level drops to the arc value. A typical high voltage pulse generated by the spiral line has an amplitude of a few kilovolts and a width of about 0.5 $\mu$s and is followed by rapidly decaying high frequency oscillations of about 1 MHz. The number of such pulses is determined by the time constant of the circuit and may be selected to optimize starting of a particular type of HID lamp, as set forth by co-pending patent application of W. W. Byszewski, C. N. Fallier, Jr. and J. N. Lester, "Multipulse Starting Aid for High-Intensity Discharge Lamps", (Docket No. 86-3-053), United States patent application, Ser. No. 07/000495, filed Jan. 5, 1987. The amplitude and width of the pulses may be varied over a wide range to meet the starting (and hot restarting) requirements of most HID lamps, as set forth in U.S. Pat. No. 4,484,085, by C. N. Fallier, Jr. and J. M. Proud, entitled "Spiral Line Voltage Pulse Generator Characterized by Secondary Winding", issued Nov. 20, 1984, and by a co-pending patent application filed by C. N. Fallier, Jr. and J. N. Lester, "Method and Apparatus for Starting High Intensity Discharge Lamps, (Docket No. 85-1-151) U.S. patent application, Ser. No. 812,577, filed Dec. 23, 1985.

Electrodeless HID lamps have been started and operated by ultrahigh frequency (915 MHz) power sources, as reported by P. O. Haugsjaa, R. J. Regan and W. H. McNeill, "Electrodeless Light Source", in U.S. Pat. No. 3,993,927, issued Nov. 23, 1976. The lamp impedance during the starting phase and during operation is matched to the power source by switchable circuits described in U.S. Pat. Nos. 3,943,401 and 4,002,944, thereby improving lamp startability.

Several patents such as U.S. Pat. Nos. 4,041,352 and 4,247,800 describe additional assistance in starting processes by ultraviolet (UV) radiation or radioactive material radiation, respectively. Very strong effects of UV radiation on the starting process have also been observed in electroded, ballast operated, HID lamps, and utilization of this effect has been suggested by J. M. Proud, W. W. Byszewski, and C. N. Fallier, Jr., "Arc Discharge Lamp with Ultraviolet Enhanced Starting Circuit", (Docket No. 24,987) in their co-pending U.S. application, Ser. No. 686,975, filed Dec. 27, 1984.

The optimum breakdown condition in a particular gas is described in detail by S. C. Brown, *Introduction to Electrical Discharges in Gases*, J. Wiley & Sons, Inc., New York (1966), and by A. D. MacDonald, *Microwave Breakdown in Gases*, J. Wiley & Sons, Inc., New York (1966). U.S. Pat. No. 3,943,401, issued Mar. 9, 1976 to P. O. Haugsjaa, R. J. Regan, and W. H. McNeill, is entitled, "Electrodeless Light Source Having a Lamp Holding Fixture Which has a Separate Characteristic Impedance for the Lamp Starting and Operating Mode".

U.S. Pat. No. 4,002,944 issued Jan. 11, 1977 to W. H. McNeill, P. O. Haugsjaa, J. M. Lech, and R. J. Regan is entitled, "Internal Match Starter for Termination Fixture Lamps".

U.S. Pat. No. 4,041,352, mentioned above, was issued Aug. 9, 1977 to W. H. McNeill, P. O. Haugsjaa, J. Lech and R. J. Regan, entitled, "Automatic Starting System for Solid State Powered Electrodeless Lamps".

U.S. Pat. No. 4,247,800, also mentioned hereinabove, issued Jan. 27, 1981 to J. M. Proud, R. J. Regan, P. O. Haugsjaa, and D. H. Baird, "Radioactive Starting Aids for Electrodeless Light Sources".

With one exception, the foregoing cited patents and patent applications have been assigned to the assignee of this application: GTE Laboratories Incorporated. Patent application Ser. No. 812,577 has been assigned to a related company.

SUMMARY OF THE INVENTION

Another object of this invention is to provide new and improved methods of and apparatus for starting of high intensity discharge lamps utilizing minimal power therefor.

Still another object of this invention is to provide new and improved methods of and apparatus for starting of high intensity discharge lamps and for maintenance of their lamp operation.

Yet another object of this invention is to provide for voltage multiplication with the provision of a UHF starting signal.

In accordance with one aspect of the invention, a method of enhancing the ignition of a high intensity discharge lamp is achieved by applying an ultrahigh frequency (UHF) electric field to the lamp. In accordance with various features of the invention, the field can be applied at a modest power level; an alternating voltage, such as 50 or 60 Hertz, can be applied across the lamp.

In accordance with another aspect of the invention, apparatus for providing light includes a high intensity discharge lamp that has an envelope of light transmitting material for enclosing a metal-halide vapor. A first electrode extends through one end of the lamp, while a second electrode extends through an opposite end of the lamp, so that the electrodes are spaced apart within the envelope. A circumferential conductive mesh, coupled to the second electrode but physically separated from the first electrode, surrounds the envelope. Means are provided for applying an alternating current at household frequency to the electrodes. Means are provided for applying an ultrahigh frequency field to the lamp. In accordance with certain features, the household frequency can be 50 Hertz or 60 Hertz. The lamp can have a supporting base which houses the ultrahigh frequency field applying means. A ballast can house the means for providing an alternating voltage at household frequency. In accordance with specific features, three separate conductive means are provided for conveying ac power to the ballast, a neutral line to the ballast, and a ground connection to the ballast, respectively. Two other conductive means are supplied from the output of the ballast for providing balanced alternating voltage thereacross. The two conductive means from the ballast output are inductively coupled to the electrodes. A sixth conductive means conveys a ground connection from the ballast. An ultrahigh frequency oscillator, adapted to be excited by the output of the ballast, has a pair of output terminals. The two terminals are capacitively coupled to the two electrodes, respectively. With specific features of the invention, the two terminals can have an inductor shunted thereacross, a first capacitive means is inductively coupled to one of the electrodes, and a resistive-capacitive parallel circuit is coupled across the two capacitances. The electrodes are aligned along a common axis. The ultrahigh frequency field, when produced, is within a range of 0.5 GHz to 3 GHz, at the lamp, such as 915 MHz, 2450 MHz, and 2.5 GHz. The first electrode can extend axially within the circumferential conductive mesh a distance of 3 centimeters.

BRIEF DESCRIPTION OF THE DRAWING

Other objects, advantages, and features of this invention, together with its scope and mode of operation, will become more apparent from the following specification, when read in conjunction with the accompanying drawing, in which:

FIG. 5(*b*) is a plot of voltage multiplication factor versus the ratio of electrode length, l , and a quarter-wavelength, $\lambda/4$, of the oscillating power;

FIG. 6(*b*) is a chart showing the position of the minima obtained in FIG. 6(*a*) as a function of frequency and electrode separation.

DESCRIPTION OF PREFERRED EMBODIMENTS

Figure 1:
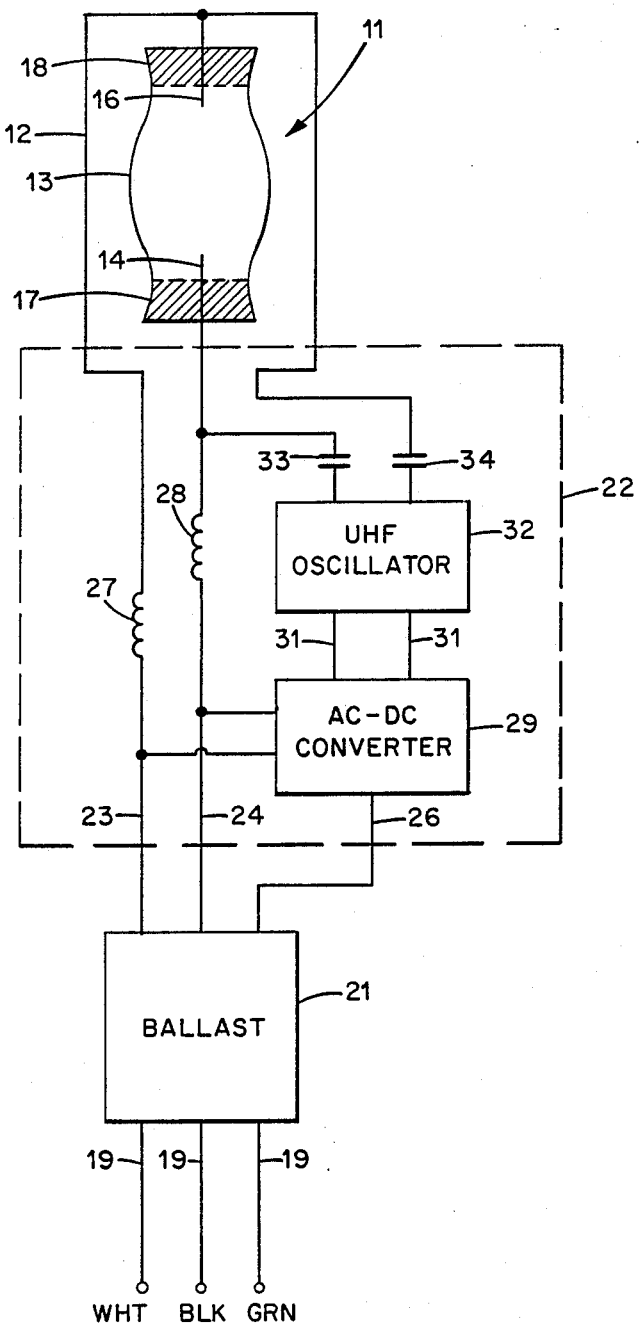
FIGS. 1, 2, and 3 are diagrams, respectively, of three embodiments of the invention including a high intensity discharge lamp, the subject matter enclosed by dashed outline being located in the lamp base.

Referring to FIG. 1, there is depicted one aspect of the invention relating to the ultrahigh frequency starting of high intensity discharge lamps. As depicted therein, a high intensity discharge lamp 11 is housed within a conductive mesh 12 through which light can pass. The high intensity discharge lamp 11 includes a transparent envelope 13 of light transmitting material, such as glass or quartz, having a pair of electrodes 14, 16 held at opposite ends thereof by suitable supports 17, 18, respectively. The lamp 11 houses a suitable gas such as metal halide vapor.

Conventional house current, such as 60 Hertz voltage common in the United States, or 50 Hertz voltage common in various European countries, can be applied along three lines 19—19 to a ballast 21. The three lines 19—19, identified in FIG. 1 as WHT, BLK, GRN, carry power to the lamp system.

The high intensity discharge lamp 11 can be located adjacent a housing 22, indicated in the drawing by a dashed outline. Within the housing 22 is an electronic circuitry that converts the output of the ballast 21 for properly controlling the lamp 11. The output of the ballast 21 provides an alternating current along two lines 23, 24 thereof and a ground line 26. One of the output lines 23 from the ballast 21 is coupled via an inductor 27 to the electrode 16 housed within the envelope 13 via the conductive circumferential mesh 12 that encloses the lamp 11. The other line 24 from the ballast 21 is coupled through another inductor 28 to the electrode 14 which is housed within the envelope 13. The electrode 14 does not touch the mesh 12. The electrodes 14 and 16 are spaced apart from each other and may be aligned along a common axis.

The balanced output of the ballast 21 along the lines 23, 24 are coupled to an ac to dc converter 29 together with the ground lead 26. The ac to dc converter 29 when activated by the alternating current from the ballast 21 provides a dc voltage therefrom along a pair of lines 31—31 which are in turn coupled to activate a UHF oscillator 32. The UHF oscillator 32 is coupled via capacitors 33, 34 to the electrodes 14, 16, respectively, of the lamp 11.

In operation, as ac household voltage is applied to the ballast 21 via the lines 19—19, a balanced alternating voltage at household frequency is applied across the electrodes 14, 16 of the lamp 11. Ordinarily, such voltage is insufficient to initiate starting of the lamp but it is sufficient to maintain discharge of the lamp, once initiated. The output of the ballast 21 and the lines 23 and 24, together with the ground 26, causes the ac to dc converter 29 to initiate oscillation of the UHF oscillator 32, whereby an ultrahigh frequency field is provided (via the capacitors 33, 34) across the electrodes 14, 16. The inductors 27, 28 act to isolate the UHF field from the lines 23, 24.

Figure 2:
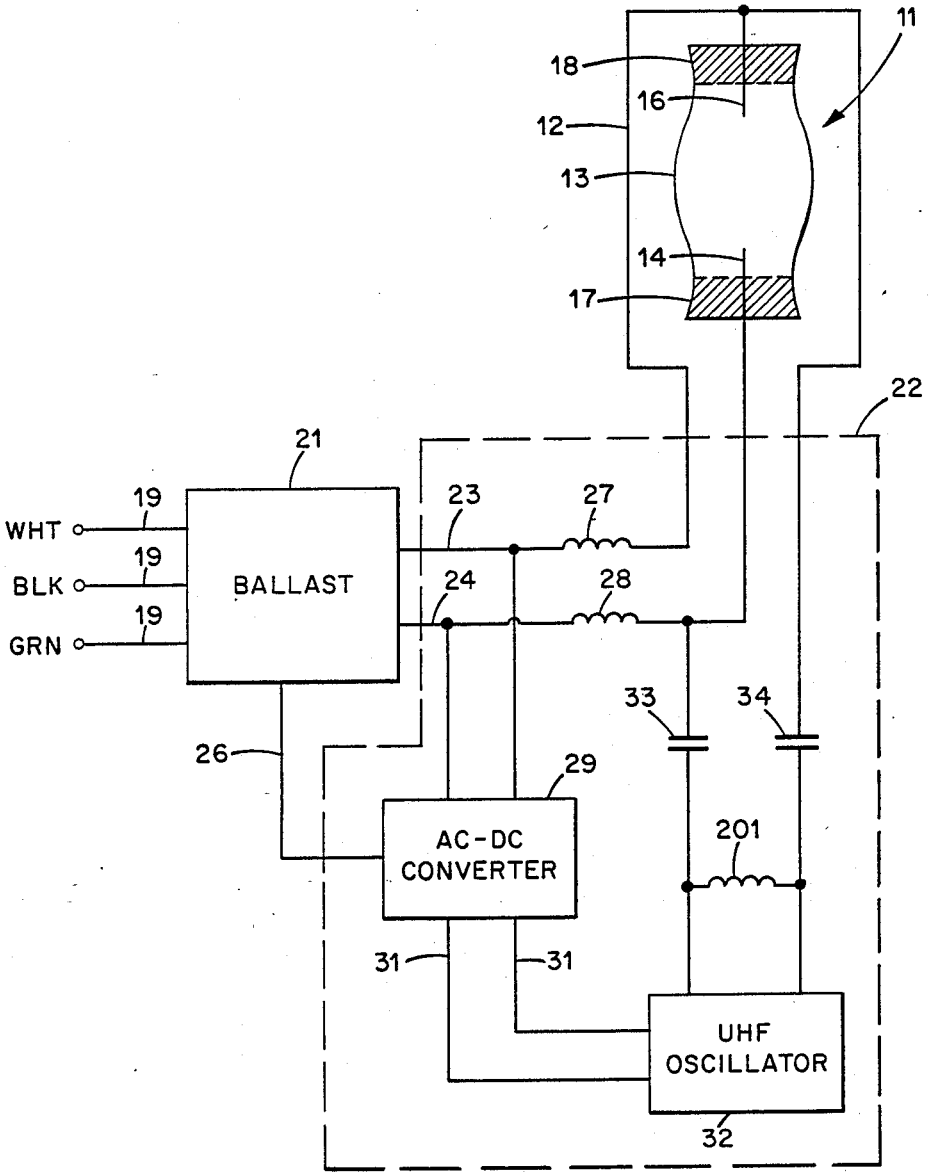

FIG. 2 depicts another embodiment of the invention similar to FIG. 1 wherein like reference numerals refer to like components. Various components as depicted in FIG. 2 are rearranged somewhat differently from that shown in FIG. 1. For example, the ballast 21 is shown to the left of the housing 22 in lieu of being beneath it; the specific location is considered immaterial. However, FIG. 2 does differ from FIG. 1 in that it further includes an inductor 201 across the output of the UHF oscillator 32. The inductor 201 acts to resonate the fringing capacitance of the electrodes 14 and 16 at the frequency of operation thereby maximizing the UHF field intensity.

Figure 3:
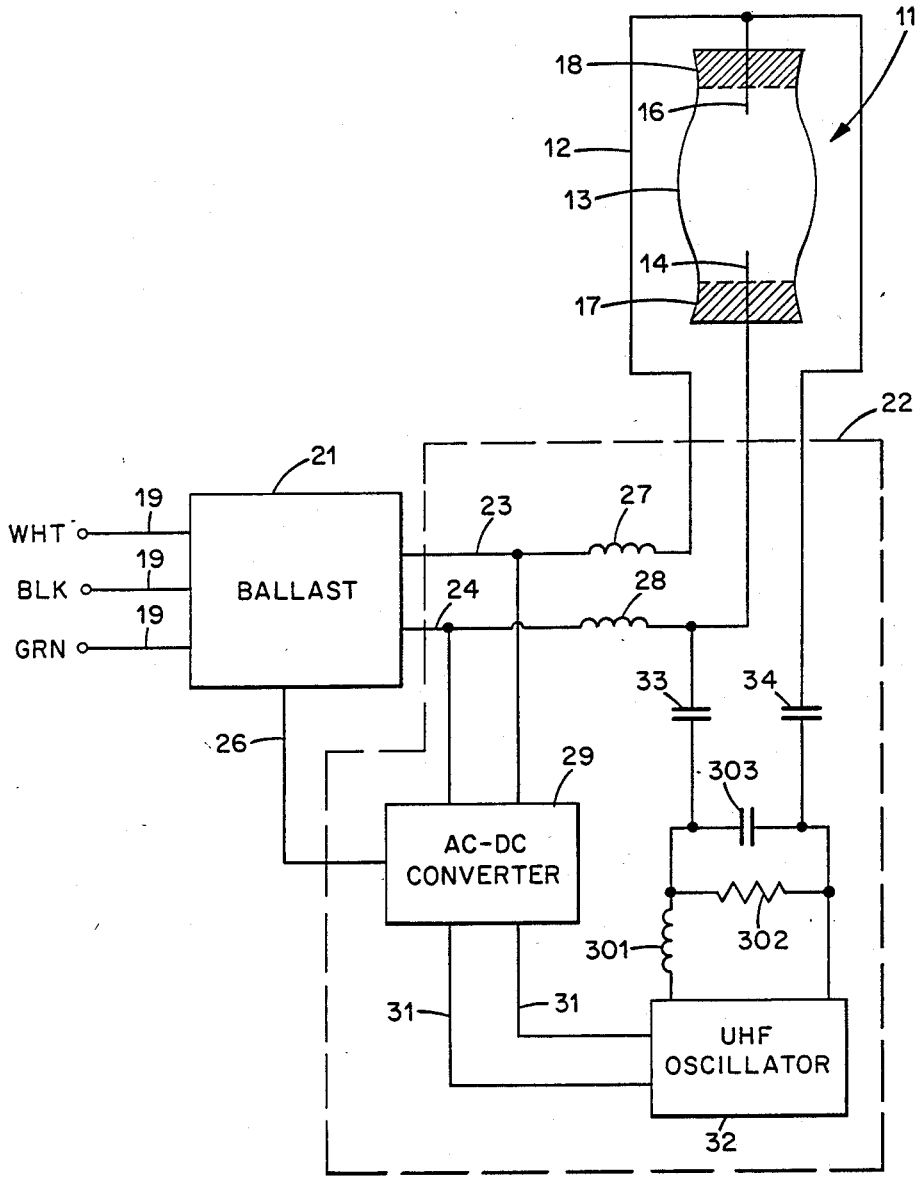

FIG. 3 depicts a third embodiment of the invention wherein, again, like components are indicated by like reference numerals. In FIG. 3, as before, the household voltage is applied along the lines 19—19 to a ballast 21. The output of the ballast 21 provides a balanced output along the output lines 23, 24 thereof, together with a ground line 26. The lines 23, 24 are coupled to an ac to dc converter 29, together with the ground line 26. The lines 23, 24 are coupled via inductors 27, 28, respectively, to the electrodes 16, 14, respectively, the connection of the inductor 27 to the electrode 16 being via the mesh 12. As before, the output of the ac to dc converter 29 is coupled to a UHF oscillator 32. The output of the UHF oscillator 32 is coupled to the electrodes 14, 16 of the lamp 11 via the capacitors 33, 34, respectively. However, in the embodiment depicted in FIG. 3, one output of the UHF oscillator 32 is coupled through the capacitor 33 to the electrode 14 via an inductor 301. The joint connection of the inductor 301 and the capacitor 33 is coupled to the other output of the oscillator 32 via a parallel resistive-capacitive circuit 302, 303 which provides enhanced tuning thereto.

Electroded 100 W metal halide lamps (miniature double ended arc tubes), in the prior art, typically included a lag ballast in conjunction with RF or modified HPS-"Advance" starters for initiating starting. Utilization of this invention, using ultrahigh frequency (UHF) such as 0.5 to 3 GHz to assist starting, eliminates high voltage stress problems and power line noise which are characteristic of such prior art starters.

Referring again to FIG. 1, the embodiment depicted therein utilizes a small lightweight solid state oscillator 32 which is used to provide the UHF starting power for the lamp 11. The UHF signal is injected into the high characteristic impedance electrodes 14, 16 of the lamp 11 via the capacitors 33, 34 which serve as UHF short circuits and decouple the UHF circuit from the primary ac power. The inductors 27, 28 decouple the UHF starting signal from the ac ballast 21, thus minimizing high frequency noise. Upon starting, the lamp impedance drops thereby causing the UHF oscillation to cease.

The embodiment depicted in FIG. 2 has a further improvement in the foregoing implementation which is achieved by adding a high Q inductor 201 across the outputs of the oscillator 32 to provide voltage multiplication. For instance, the stray capacitance of the lamp electrodes 14, 16 may be resonated at the starting frequency with the inductor 201. Hence, low level forward power produces a large potential across the electrodes 14, 16.

Another embodiment as depicted in FIG. 3 provides voltage transformation via a step-up L-section 301, 303 terminated in a high value resistance 302.

The UHF oscillator 32, indicated in FIGS. 1, 2, and 3, may be composed of static induction transistors (SIT) as high operating voltage levels attainable with SIT would ease transformer requirements. However, other solid state devices, such as bipolar junction transistors or MOSFETs could be used in this application as well.

The electroded 100 W metal halide voltage starting circuits can be enclosed within the base 22 of the lamp. An advantage of this invention is that deleterious effects such as electrode sputtering caused by high voltage starting pulses are largely alleviated by the easier (more rapid) starting provided by the UHF means. Another advantage of the UHF starting means lies in the reduced levels of radio frequency interference which are produced during a starting process when high voltage RF pulses are implemented in the present systems. Furthermore, by choosing the ISM bands (Industrial Scientific Medical) at 915 and 2450 MHz, interference problems are, in effect, nil.

Figure 4:
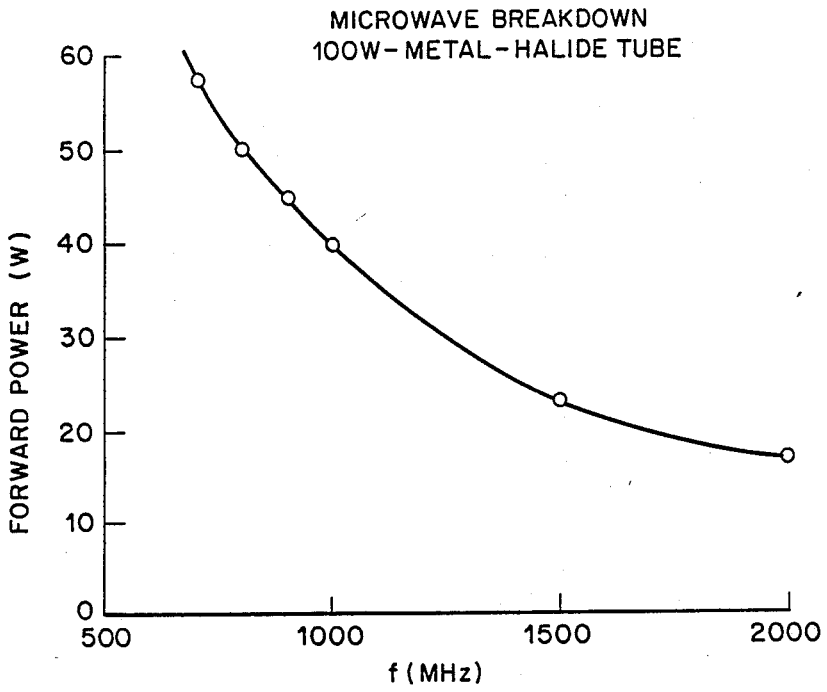
FIG. 4 is a plot of the forward power required to produce breakdown, in a metal halide arc tube used in an embodiment of this invention, as a function of oscillation frequency.

FIG. 4 is a plot of forward power required to produce breakdown as a function of the oscillation frequency for an experimental version of the instant invention. The data shows a very substantial decrease in breakdown forward power level with increasing frequency. A further reduction is possible when frequency or the electrode length is increased. A minimum appears at 2.5 GHz with existing electrode length of 3 centimeters or at 2 GHz with the length increased to 3.75 centimeters.

Figure 5A:
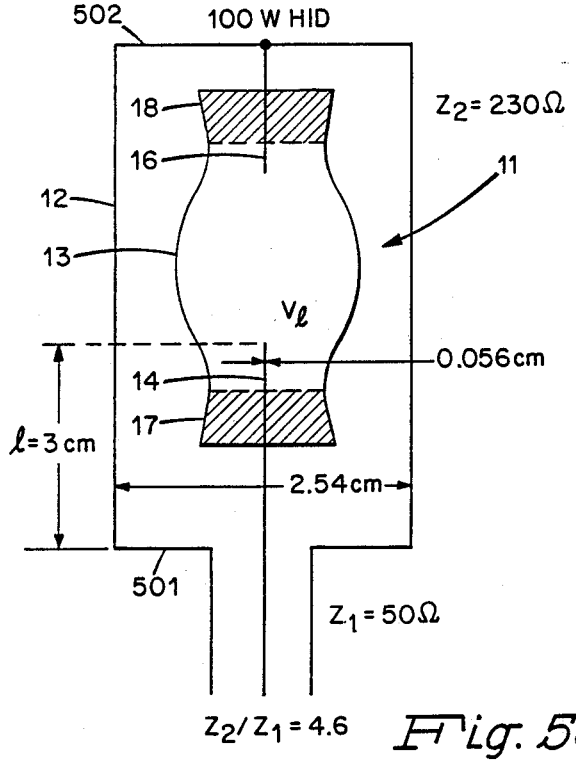
FIG. 5(*a*) is a diagram of a discharge vessel, used in an embodiment of the invention, with various physical dimensions depicted thereon.
Figure 5B:
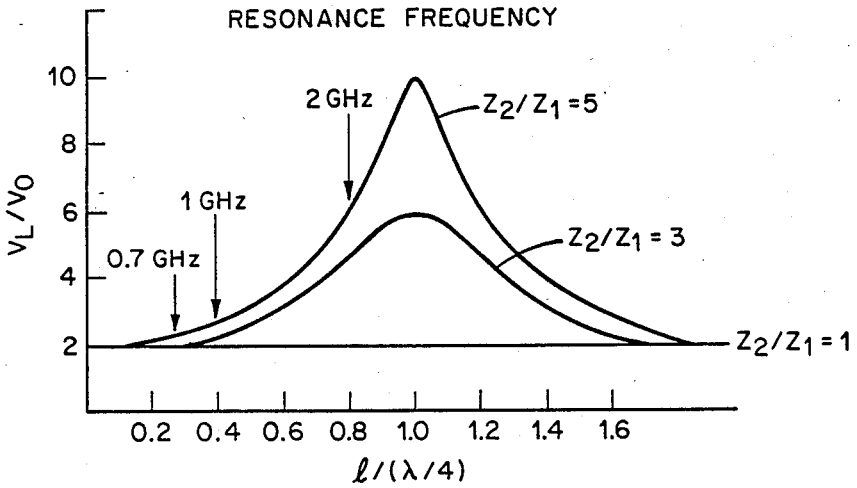

FIG. 5(*a*) is a diagram illustrating the physical dimensions of a discharge vessel used in such studies. As depicted therein, the conductive circumferential mesh extends from one end 501 near the electrode 14 to an opposite end 502 near the electrode 16. The electrode 14 extends within the circumferential mesh 12 for a distance, l, equal to 3 centimeters. The electrode 14 has a diameter of 0.056 centimeter and the diameter of the circumferential mesh 12 is 2.54 centimeters. The input impedance $z_1$, along a coaxially line, is 50 ohms. The impedance, $z_2$, of the 100 W high intensity discharge lamp 12 is 230 ohms. Thus, the ratio of $z_2/z_1=4.6$.

FIG. 5(*b*) illustrates the calculated voltage multiplication factor, $V_L/V_O$, versus the ratio of the electrode length, l , and a quarter-wave length, $\lambda/4$, of the oscillating power. The ratio of the characteristic impedance of the discharge vessel 11 and the power source, $z_2/z_1$, is used as a parameter. The ten-fold voltage enhancement can be reached at the resonance ($l=\lambda/4$) when $z_2/z_1=5$. The impedance $z_2$ is controlled by the geometry of the discharge vessel and, in the example depicted in FIG. 5(*a*), the value $z_2/z_1$ is 4.6, resulting in a multiplication factor slightly less than 10. The ratio $V_L/V_O$ is the ratio of $V_L$, the voltage $V_l$ at the top or end of the electrode 14 (as viewed in FIG. 5*a*), to $V_O$, the voltage at the bottom of the electrode 14. $V_O$, as conventionally used, represents output voltage.

Figure 6A:
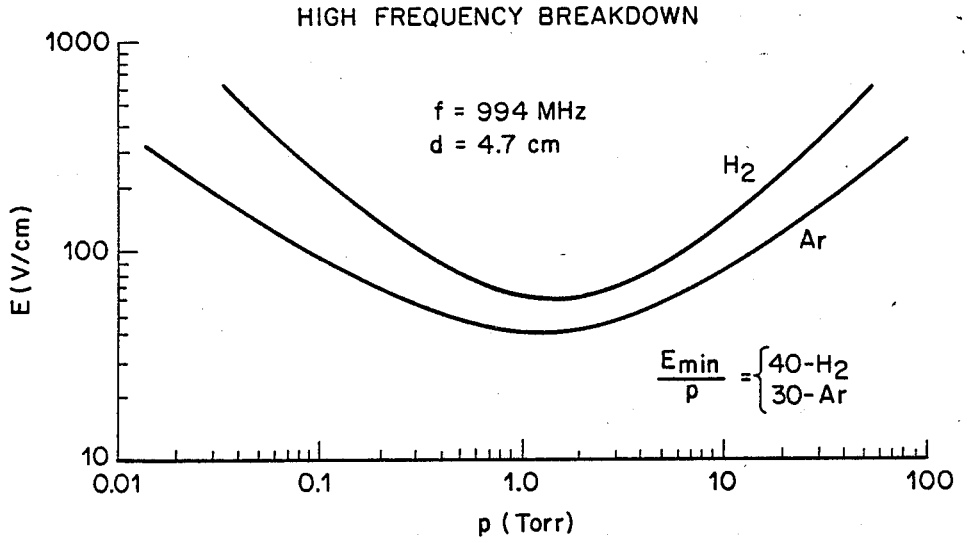
FIG. 6(*a*) is a plot of frequency breakdown as a function of pressure in argon and hydrogen.
Figure 6B:
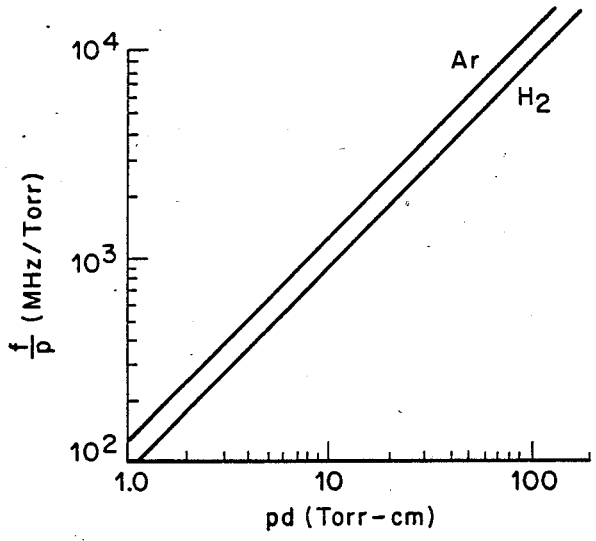

FIG. 6(*a*) is a chart that shows the high frequency breakdown field as a function of pressure in argon and hydrogen. A deep minimum (optimum breakdown condition) at the pressure range of 1 torr is observed for f=994 MHz and the electrode separation d=4.7 centimeters. The data for such a chart is available from publications such as S. C. Brown, "Introduction to Electrical Discharges in Gases"; and A. D. MacDonald, "Microwave Breakdown in Gases", cited above.

FIG. 6(*b*) is a chart that projects the position of the minima depicted in FIG. 6(*a*) as a function of frequency and electrode separation. In argon at f=2.5 GHz and d at about 1.25 centimeters, the minimum is expected at p about 5 torr. A buffer gas pressure in 100 W metal halide lamp is 100 torr and, therefore, the minimum cannot be attained. A decrease in buffer gas pressure and electrode separation should be considered in order to reach such an optimum condition characterized by the gas medium properties.

In constructing an embodiment of this invention, a 100 W metal halide arc tube was used as a discharge vessel with a characteristic impedance $z_2=230$ ohms. A 50 ohm microwave circuit delivered power to the vessel fixture from a signal generator having a variable oscillation frequency in the GHz range.

The high frequency dependence of the required power for gas breakdown in a typical lamp has, typically, two minima. The first one is related to the geometry of the breakdown vessel (HID lamp). This minimum occurs at the frequency at which the length of the electrode becomes equal to one-quarter of wavelength ($l=\lambda/4$). In a 100 W metal halide lamp, for which the length of the electrode is about 3 centimeters (see FIG. 1), the minimum occurs at the frequency 2.5 GHz. Gas will breakdown therefore at lower values of the applied power than required for dc breakdown due to the resonance voltage multiplication effect at the electrode tip. The value of the voltage multiplication factor depends on the relative impedance of the breakdown vessel and the power source. The 100 W HID test lamp fixture that was constructed was designed for an impedance ratio of 5 which corresponds to the voltage multiplication factor of 10. Thus, in this example, the power required for the lamp breakdown at the frequency 2.5 GHz is about 10 times lower than at the frequency 0.5 GHz or below.

Another minimum occurs at a frequency which defines the optimum breakdown condition in a particular gas, as described in detail by Brown, supra, and MacDonald, supra. The frequency for optimum breakdown is a strong function of the gas pressure and is typically in the GHz frequency range for gas pressures of a few torr. Typically, the breakdown field under optimum conditions may be 50 V/cm or less, although in the 100 W Metalarc lamp with an argon pressure of 100 torr this may not be accessible in the practical range of frequencies.

This invention utilizes the above described minima either separately or in combination to provide conditions favoring relatively easy starting of HID lamps. As a result, the starting circuit may be more modest in size and complexity than conventional high voltage starting circuits.

The term "household frequency", used herein, is meant to include such commercially available frequencies as 60 Hertz commonly used throughout the United States, and 50 Hertz commonly used throughout Europe.

What is claimed is:

1. A method of enhancing the ignition of an electroded, high intensity discharge lamp having an envelope of light transmitting material for enclosing a metal halide vapor, said lamp having a retively higher impedance before ignition and a reletively lower impedance after ignition, said method comprising the steps of:

applying an alternating current (ac) voltage across said lamp from an ac source and, simultaneously therewith, applying an ultrahigh frequency (UHF) electric field to said lamp from an impedance dependent UHF source sufficient to initiate an electric discharge, so that the lower impedance of the lamp after ignition causes oscillation of the UHF source to cease while the discharge is sustained by power from the ac source.

2. The method as recited in claim 1 wherein said voltage is at 60 Hertz.

3. The method as recited in claim 1 wherein said voltage is at 50 Hertz.

4. The method as recited in claim 1 wherein the dimensions of the electrode and the frequency of said UHF electric field is so selected to promote field enhancement at a tip of said electrode.

5. The method as recited in claim 4 wherein said field enhancement at said tip of said electrode is maximized.

6. The method recited in claim 1 further comprising the step of isolating the UHF electric field from the ac source.

7. The method as recited in claim 1 wherein the UHF source is capacitively coupled to the lamp.

8. Apparatus for providing light comprising a high intensity discharge lamp having an envelope of light transmitting material for enclosing a metal halide vapor, said lamp having a pair of opposed ends, a first electrode extending through one of said ends into said envelope, a second electrode extending through the other of said ends into said envelope whereby said electrodes are separated apart within said envelope, and a circumferential conductive mesh surrounding said envelope, said mesh being coupled to said second electrode but physically separated from said first electrode;

means for applying an alternating voltage at household frequency to said electrodes; and means for applying an impedance dependent ultrahigh frequency electric field to said lamp.

9. The apparatus as recited in claim 8 wherein said household frequency is 50 Hertz.

10. The apparatus as recited in claim 8 wherein said household frequency is 60 Hertz.

11. The apparatus as recited in claim 8 wherein said lamp has a supporting base therefor, and said means for applying an ultrahigh frequency field is housed within said base.

12. The apparatus as recited in claim 11 further comprising a ballast, said ballast being adapted to house said means for applying an alternating voltage at household frequency.

13. The apparatus as recited in claim 8 wherein said electrodes are aligned along a common axis.

14. The apparatus as recited in claim 8 wherein said ultrahigh frequency oscillating means, when excited, produces an ultrahigh frequency field within a range of 0.5 GHz to 3 GHz at said lamp.

15. The apparatus as recited in claim 14 wherein said field is produced at 915 MHz.

16. The apparatus as recited in claim 14 wherein said field is produced at 2450 MHz.

17. Apparatus for providing light comprising a high intensity discharge lamp having an envelope of light transmitting material for enclosing a metal halides vapor, said lamp having a pair of opposed ends, a first electrode extending through one of said ends into said envelope, a second electrode extending through the other of said ends into said envelope whereby said electrodes are separated apart within said envelope, and a circumferential conductive mesh surrounding said envelope, said mesh being coupled to said second electrode but physically separated from said first electrode;

means for applying an alternating voltage at household frequency to said electrodes;

means for applying an ultrahigh frequency field to said lamp, wherein said household frequency is 60 Hertz, said lamp has a supporting base therefor, and said means for applying an ultrahigh frequency field is housed within said base;

a ballast, said ballast being adapted to house said means for applying an alternating voltage at household frequency;

a first conductive means for conveying ac power to said ballast;

a second conductive means for conveying a neutral line to said ballast;

a third conductive means for conveying a ground connection to said ballast;

a fourth conductive means and a fifth conductive means for providing balanced alternating voltage thereacross, outputted from said ballast;

a sixth conductive means for conveying a ground connection from said ballast;

a first inductive means coupled across said fourth conductive means and one of said electrodes;

a second inductive means coupled across said fifth conductive means and the other of said electrodes;

ultrahigh frequency oscillating means adapted to be excited by the presence of said balanced alternating voltage across said fourth conductive means and said fifth conductive means, said oscillating means having a pair of output terminals;

a first capacitive means coupling one of said terminals to said one of said electrodes, and a second capacitive means coupling the other of said terminals to said other of said electrodes.

18. The apparatus as recited in claim 17 further comprising inductive means coupled across said pair of said output terminals.

19. The apparatus as recited in claim 17 wherein said first capacitive means is coupled to said one of said electrodes via an inductive means, and wherein the apparatus further comprises a resistive-capacitive parallel circuit coupled across said first capacitive means and said second capacitive means.

20. Apparatus for providing light comprising a high intensity discharge lamp having an envelope of light transmitting material for enclosing a metal halide vapor, said lamp having a pair of opposed ends, a first electrode extending through one of said ends into said envelope, a second electrode extending through the other of said ends into said envelope whereby said electrodes are separated apart within said envelope, and a circumferential conductive mesh surrounding said envelope, said mesh being coupled to said second electrode but physically separated from said first electrode;

means for applying an alternating voltage at household frequency to said electrodes; and means for applying an impedance dependent ultrahigh frequency electric field to said lamp;

wherein the length of each electrode is equal to one-quarter of the wavelength of the ultrahigh frequency field.

21. The apparatus as recited in claim 20 wherein said first electrode extends axially within said circumferential conductive mesh a distance of 3 centimeters, and said ultrahigh frequency oscillating means, when excited, produces an ultrahigh frequency field at the frequency 2.5 GHz.

* * * * *